US011802319B2

(12) United States Patent
Lee et al.

(10) Patent No.: US 11,802,319 B2
(45) **Date of Patent: *Oct. 31, 2023**

(54) DOUBLE ORIENTED ELECTRICAL STEEL SHEET AND METHOD FOR MANUFACTURING SAME

(71) Applicant: POSCO, Pohang-si (KR)

(72) Inventors: Seil Lee, Pohang-si (KR); Sang-Woo Lee, Pohang-si (KR); Su-Yong Shin, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 140 days.

This patent is subject to a terminal disclaimer.

(21) Appl. No.: 16/958,276

(22) PCT Filed: Dec. 17, 2018

(86) PCT No.: PCT/KR2018/016041

§ 371 (c)(1),
(2) Date: Jun. 26, 2020

(87) PCT Pub. No.: WO2019/132363

PCT Pub. Date: Jul. 4, 2019

(65) Prior Publication Data

US 2021/0054474 A1 Feb. 25, 2021

(30) Foreign Application Priority Data

Dec. 26, 2017 (KR) ..... 10-2017-0179929

(51) Int. Cl.

| | |
|---|---|
| ***C21D 9/46*** | (2006.01) |
| ***C21D 6/00*** | (2006.01) |
| ***C21D 8/12*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |
| ***H01F 1/147*** | (2006.01) |

(52) U.S. Cl.

CPC ..... *C21D 9/46* (2013.01); *C21D 6/008* (2013.01); *C21D 8/1222* (2013.01); *C21D 8/1233* (2013.01); *C21D 8/1272* (2013.01); *C22C 38/001* (2013.01); *C22C 38/002* (2013.01); *C22C 38/02* (2013.01); *C22C 38/04* (2013.01); *C22C 38/06* (2013.01); *C22C 38/14* (2013.01); *H01F 1/147* (2013.01); *C21D 2201/05* (2013.01); *C22C 2202/02* (2013.01)

(58) Field of Classification Search

CPC ..... C21D 9/46; C21D 6/008; C21D 8/1222; C21D 8/1233; C21D 8/1272; C21D 2201/05; H01F 1/147; H01F 1/14783; C22C 2202/02

See application file for complete search history.

(56) References Cited

U.S. PATENT DOCUMENTS

| | | | | | |
|---|---|---|---|---|---|
| 3,240,638 | A * | 3/1966 | Wiener | C21D 8/1272 | 148/112 |
| 4,618,377 | A * | 10/1986 | Nakamura | H01F 1/14783 | 148/253 |
| 5,948,180 | A * | 9/1999 | Tomida | C21D 8/12 | 310/216.006 |
| 6,322,639 | B1 * | 11/2001 | Matsuzaki | C21D 8/1222 | 148/306 |
| 6,562,473 | B1 * | 5/2003 | Okabe | H01F 1/14775 | 148/310 |
| 2021/0381073 | A1 * | 12/2021 | Lee | C22C 38/001 | |

FOREIGN PATENT DOCUMENTS

| | | | | |
|---|---|---|---|---|
| CN | 1308143 | A | 8/2001 | |
| CN | 105274427 | A | 1/2016 | |
| EP | 0452153 | A2 | 4/1991 | |
| EP | 0906963 | B1 | 5/2002 | |
| EP | 3257958 | A1 * | 12/2017 | C21D 6/005 |
| EP | 3257958 | A1 | 12/2017 | |
| JP | H01-139722 | A1 | 6/1989 | |
| JP | 2001-098330 | A | 4/2001 | |
| JP | 2001-164344 | A | 6/2001 | |
| JP | 2001-181738 | A | 7/2001 | |
| JP | 2002-129233 | A | 5/2002 | |

(Continued)

OTHER PUBLICATIONS

Atsumi Haruhiko, JP-2017122269-A English machine translation, Jul. 2017 (Year: 2017).*

Richard A. Robie and Philip M. Bethke, Molar Volumes and Densities of Minerals, Oct. 1, 1983, United States Department of the Interior, Geological Survey, pp. 1-30 (Year: 1983).*

Chinese Office Action dated May 17, 2021 issued in Chinese Patent Application No. 201880084868.0.

International Search Report dated Apr. 2, 2019 issued in International Patent Application No. PCT/KR2018/016041 (with English translation).

(Continued)

*Primary Examiner* — Nicholas A Wang
*Assistant Examiner* — Maxwell Xavier Duffy
(74) *Attorney, Agent, or Firm* — Morgan, Lewis & Bockius LLP

(57) ABSTRACT

A double oriented electrical steel sheet includes: 2.0 to 6.0% of Si, 0.0005 to 0.04% of Al, 0.0001 to 0.003% of S, 0.02 to 1.0% of Mn, equal to or less than 0.003% of N, excluding 0%, equal to or less than 0.01% of C, excluding 0%, equal to or less than 0.01% of Ti excluding 0%, 0.005 to 0.10% of P as wt %, and a remainder including Fe and inevitable impurities. Such a double oriented electrical steel sheet satisfies Formula 1:

$$[Mn]/[S] \geq 60, \quad \text{[Formula 1]}$$

where, [Mn] and [S] are contents (wt %) of Mn and S, respectively.

19 Claims, No Drawings

(56) References Cited

FOREIGN PATENT DOCUMENTS

| | | | | |
|---|---|---|---|---|
| JP | 2005-179745 | A | | 7/2005 |
| JP | 2008-106367 | A | | 5/2008 |
| JP | 2008-150697 | A | | 7/2008 |
| JP | 4119689 | B2 | | 7/2008 |
| JP | 4608467 | B2 | | 1/2011 |
| JP | 2012-126980 | A | | 7/2012 |
| JP | 2017-122269 | A | | 7/2017 |
| JP | 2017122269 | A | * | 7/2017 |
| JP | 2017-133086 | A | | 8/2017 |
| KR | 10-1993-0010323 | B1 | | 10/1993 |
| KR | 10-0294352 | B1 | | 9/2001 |
| KR | 10-0797895 | B1 | | 1/2008 |

OTHER PUBLICATIONS

Extended European Search Report dated Mar. 9, 2021 issued in European Patent Application No. 18894288.2.
Japanese Office Action dated Jul. 27, 2021 issued in Japanese Patent Application No. 2020-536037.

* cited by examiner

DOUBLE ORIENTED ELECTRICAL STEEL SHEET AND METHOD FOR MANUFACTURING SAME

CROSS-REFERENCE OF RELATED APPLICATIONS

This application is the U.S. National Phase under 35 U.S.C. § 371 of International Patent Application No. PCT/KR2018/016041, filed on Dec. 17, 2018, which in turn claims the benefit of Korean Application No. 10-2017-0179929, filed on Dec. 26, 2017, the entire disclosures of which applications are incorporated by reference herein.

BACKGROUND OF THE INVENTION

(a) Field of the Invention

The present disclosure relates to a double oriented electrical steel sheet and a manufacturing method thereof. In particular, the present disclosure relates to a double oriented electrical steel sheet for providing excellent magnetism in a rolling direction and a transverse direction by appropriately controlling a ratio of Mn and S in an alloying composition, and a manufacturing method.

(b) Description of the Related Art

A method for increasing magnetic flux density of an electrical steel sheet is improving texture of a steel and arranging an axis of <100> in a magnetization direction is known to be the most efficient, and an additional method in use is reducing an alloy amount of the steel to increase a fraction for Fe to occupy the steel, and allowing a saturated magnetic flux to approach a pure iron to thus increase the magnetic flux density. An oriented electrical steel sheet among them uses an orientation of {110}<001> that is referred to as a Goss orientation, and it is conventionally obtained through a process of manufacturing a slab, and hot rolling, hot-rolled steel sheet annealing, cold rolling, decarburization during first recrystallization, nitride, and secondary high-temperature annealing it. This has, however, excellent magnetism in the rolling direction (RD) and very poor magnetism in the transverse direction (TD), so it is only usable for a transformer of which the magnetization direction is set to be the rolling direction. Therefore, it is required to manufacture an electrical steel sheet for controlling texture in parallel to the magnetization direction and the axis of <100> with different texture. The magnetization direction of a rotation device conventionally rotates in the sheet, so the axis of <100> must be parallel to the sheet, and a frequently observed orientation from a steel material from among the orientations in such a condition is the orientation of {100}<011>. The axis of <100> is parallel to a direction that is inclined in a transverse direction (TD) from the rolling direction by 45 degrees, so the magnetism is excellent when the magnetization direction is inclined from the rolling direction of the sheet by 45 degrees. However, this orientation disappears in the case of a recrystallization annealing with a cold-rolling stable orientation, so it is not used as an electrical steel sheet material. In a like manner, there is an orientation of {100}<001>, and this is a cube on face orientation of which usefulness has been acclaimed in the past, but a method for manufacturing it through a device that allows no massive industrial production such as performing cross rolling or vacuum annealing. Particularly, the cross-rolling method may not be used such that continuous production of a material is impossible, and in the case of a large generator, a core in a cylindrical form of several meters must be manufactured, so it may not be applicable to a process for dividing the core into several to several tens and assembling them on the sheet, and productivity is severely lowered. In the case of generators, a general turbine generator generates electricity according to commercial electrical frequencies of respective countries such as 50 Hz or 60 Hz, so the magnetic property at 50 Hz and 60 Hz is important, but in the case of a generator with a slow rotation rate such as wind power generators, the magnetic characteristic with a DC and at 30 Hz or below is important. Therefore, regarding the above-noted devices, the characteristic of the magnetic flux density indicating a degree of magnetization is more important than the iron loss generated in AC magnetism, and it is generally estimated with magnetic flux density of B8. The magnetic flux density of B8 represents a magnetic flux density value of a steel sheet when intensity of a magnetic field is 800 Nm, it is mainly measured at the AC magnetism of 50 Hz, and depending on cases, it may be measured at the DC or at the frequency of 50 Hz or less. The above information disclosed in this Background section is only for enhancement of understanding of the background of the invention, and therefore it may contain information that does not form the prior art that is already known in this country to a person of ordinary skill in the art.

SUMMARY OF THE INVENTION

The present invention has been made in an effort to provide a double oriented electrical steel sheet and a manufacturing method thereof.

The present invention has been made in another effort to provide a double oriented electrical steel sheet with excellent magnetism in a rolling direction and a transverse direction by appropriately controlling a ratio of Mn and S in an alloying composition, and a manufacturing method thereof.

An exemplary embodiment of the present invention provides a double oriented electrical steel sheet including: as wt %, 2.0 to 6.0% of Si, 0.0005 to 0.04% of Al, 0.0001 to 0.003% of S, 0.02 to 1.0% of Mn, equal to or less than 0.003% of N (excluding 0%), equal to or less than 0.01% of C (excluding 0%), equal to or less than 0.01% of Ti (excluding 0%), 0.005 to 0.10% of P, and a remainder including Fe and inevitable impurities, and satisfying Formula 1.

$$[Mn]/[S] \geq 60 \quad \text{[Formula 1]}$$

(Here, [Mn] and [S] are contents (wt %) of Mn and S.)

At least one of 0.001 to 0.1 wt % of Sb and 0.001 to 0.1 wt % of Sn may be further included.

At least one of equal to or less than 0.01 wt % of Mo, equal to or less than 0.01 wt % of Bi, equal to or less than 0.01 wt % of Pb, equal to or less than 0.01 wt % of Mg, equal to or less than 0.01 wt % of As, equal to or less than 0.01 wt % of Be, and equal to or less than 0.01 wt % of Sr may be further included.

An area fraction of crystal grains with an orientation within 15° from {100}<001> may be 60 to 99%.

A forsterite layer may be formed on the steel sheet, and a fraction of the area having a thickness of within 2 μm from a surface of the steel sheet of the forsterite layer may be equal to or greater than 75%.

An insulating layer may be formed on the forsterite layer, a thickness of an upper-side insulating layer and a thickness of a lower-side insulating layer are respectively 0.2 to 8 μm, and a difference between the thickness of the upper-side insulating layer and the thickness of the lower-side insulating layer may be equal to or less than 50% of the thickness of the lower-side insulating layer.

Average roughness (Ra) of the upper-side insulating layer and average roughness (Ra) of the lower-side insulating layer may be respectively 1 μm, and a difference between the average roughness (Ra) of the upper-side insulating layer and the average roughness (Ra) of the lower-side insulating layer may be equal to or less than 0.3 μm.

Br in a rolling direction and Br in a transverse direction may be equal to or greater than 1.65 T, Br in a circumferential direction may be equal to or greater than 1.55 T, and Br may be calculated from Formula 2.

$$Br=7.87/(7.87-0.0.065\times[Si]-0.1105\times[Al])\times B8 \quad \text{[Formula 2]}$$

(Here, [Si] and [Al] are contents (wt %) of Si and Al. B8 represents intensity (Tesla) of a magnetic field induced at 800 Nm.)

When a magnetic field of 1.5 T is applied, permeability $U_{DC}$ when a measured frequency is equal to or less than 0.01 Hz may be 1.2 times or more permeability $U_{50}$ at 50 Hz.

A measured value of Br after annealing the electrical steel sheet for 1 to 2 hours at a temperature of 750° C. to 880° C. may be equal to or greater than 1.65 T. Br is calculated as Formula 2.

$$Br=7.87/(7.87-0.065\times[Si]-0.1105\times[Al])\times B8 \quad \text{[Formula 2]}$$

(Here, [Si] and [Al] are contents (wt %) of Si and Al.)

(B8 represents intensity (Tesla) of a magnetic field induced at 800 A/m.)

Bh in a rolling direction is equal to or greater than 1.8 T, Bh in a transverse direction is equal to or greater than 1.7 T, Bh in a circumferential direction is equal to or greater than 1.6 T, and Bh is calculated from Formula 3.

$$Bh=7.87/(7.87-0.065\times[Si]-0.1105\times[Al])\times B25 \quad \text{[Formula 3]}$$

(Here, [Si] and [Al] are contents (wt %) of Si and Al.) (B25 represents intensity (Tesla) of a magnetic field induced at 2500 A/m.)

Another embodiment of the present invention provides a method for manufacturing a double oriented electrical steel sheet including: manufacturing a slab including: as wt %, 2.0 to 6.0% of Si, 0.0005 to 0.04% of Al, 0.0001 to 0.003% of S, 0.02 to 1.0% of Mn, 0.001 to 0.01% of N, 0.02 to 0.06% of C, equal to or less than 0.01% of Ti (excluding 0%), and 0.005 to 0.10% of P, and a remainder including Fe and inevitable impurities, and satisfying Formula 1; heating the slab; manufacturing a hot-rolled steel sheet by hot rolling the slab; manufacturing a cold-rolled steel sheet by cold rolling the hot-rolled steel sheet; performing first recrystallization annealing on the cold-rolled steel sheet; and performing secondary recrystallization annealing on the cold-rolled steel sheet having undergone a first recrystallization annealing:

$$[Mn]/[S]\geq 60 \quad \text{[Formula 1]}$$

(Here, [Mn] and [S] are contents (wt %) of Mn and S in the slab.)

The slab may satisfy Formula 4.

$$[C]/[Si]\geq 0.0067 \quad \text{[Formula 4]}$$

(Here, [C] and [Si] are contents (wt %) of C and Si in the slab.)

In the heating of the slab, a time at 1100° C. or more may be 25 to 50 minutes.

In the manufacturing of a hot-rolled steel sheet, a plurality of passes may be included, a reduction ratio of a final pass and a pass prior to the final pass may be respectively 15 to 40%, and a sum of the reduction ratios of the final pass and the pass prior to the final pass may be equal to or less than 55%.

After the manufacturing of a hot-rolled steel sheet, annealing a hot-rolled steel sheet may be further included, and in the annealing of a hot-rolled steel sheet, a time at 1100° C. or more may be 5 to 50 seconds.

After the annealing of the hot-rolled steel sheet, an average crystal grain diameter of the hot-rolled steel sheet may be 100 to 200 μm.

After the annealing of the hot-rolled steel sheet, a number of precipitates with a particle diameter of 0.1 μm or more in an area of 1 $mm^2$ of the hot-rolled steel sheet may be 100 to 4000, and a ratio (A/B) of a number (A) of precipitates with a particle diameter of 0.1 to 0.5 μm against a number (B) of precipitates with a particle diameter of greater than 0.5 μm may be equal to or greater than 1.

A temperature T2 in the annealing of a hot-rolled steel sheet and a temperature T1 in the heating of the slab may satisfy Formula 5.

$$-200\leq T1-T2\leq 30 \quad \text{[Formula 5]}$$

After the heating of the slab, a time up to the manufacturing of a hot-rolled steel sheet may be 3 to 20 minutes, and a maximum temperature from the heating of the slab to the manufacturing of a hot-rolled steel sheet may be equal to or less than an annealing temperature of 20° C. in the annealing of a hot-rolled steel sheet.

In the manufacturing of a cold-rolled steel sheet, a reduction ratio may be 50 to 70%.

In the performing of a first recrystallization annealing, a nitriding amount may be 0.01 to 0.023 wt %.

After the performing of the first recrystallization annealing, an average crystal grain diameter of the steel sheet having undergone first recrystallization annealing may be 32 to 50 μm.

After the first recrystallization annealing, applying an annealing separator including MgO may be further included.

The double oriented electrical steel sheet according to an exemplary embodiment of the present invention provides excellent magnetism in the rolling direction and the transverse direction by appropriately controlling the ratio of Mn and S in the alloying composition.

Particularly, it may be used for the generator with a slow rotation speed such as a wind power generator.

DETAILED DESCRIPTION OF THE EMBODIMENTS

It will be understood that, although the terms first, second, third, etc. may be used herein to describe various elements, components, regions, layers, and/or sections, they are not limited thereto. These terms are only used to distinguish one element, component, region, layer, or section from another element, component, region, layer, or section. Thus, a first element, component, region, layer, or section discussed below could be termed a second element, component, region, layer, or section without departing from the teachings of the present invention.

The technical terms used herein are to simply mention a particular exemplary embodiment and are not meant to limit the present invention. An expression used in the singular encompasses an expression of the plural, unless it has a clearly different meaning in the context. In the specification, it is to be understood that the terms such as "including", "having", etc., are intended to indicate the existence of specific features, regions, numbers, stages, operations, elements, components, or combinations thereof disclosed in the specification, and are not intended to preclude the possibility that one or more other specific features, regions, numbers, operations, elements, components, or combinations thereof may exist or may be added.

When a part is referred to as being "on" another part, it can be directly on the other part or intervening parts may also be present. In contrast, when an element is referred to as being "directly on" another element, there are no intervening elements therebetween.

Unless otherwise defined, all terms used herein, including technical or scientific terms, have the same meanings as those generally understood by those with ordinary knowledge in the field of art to which the present invention belongs. Such terms as those defined in a generally used dictionary are to be interpreted to have meanings equal to the contextual meanings in the relevant field of art, and are not to be interpreted to have idealized or excessively formal meanings unless clearly defined in the present application.

Unless otherwise specified, % represents wt %, and 1 ppm is 0.0001 wt %.

In an exemplary embodiment of the present invention, further including an additional element signifies that the added element is substituted for iron (Fe) that is a remainder.

An exemplary embodiment of the present invention will be described more fully hereinafter so that a person skilled in the art may easily realize the same. As those skilled in the art would realize, the described embodiments may be modified in various different ways, all without departing from the spirit or scope of the present invention.

The double oriented electrical steel sheet according to an exemplary embodiment of the present invention includes: 2.0 to 6.0% of Si, 0.0005 to 0.04% of Al, 0.0001 to 0.003% of S, 0.02 to 1.0% of Mn, equal to or less than 0.003% of N (excluding 0%), equal to or less than 0.01% of C (excluding 0%), equal to or less than 0.01% of Ti (excluding 0%), and 0.005 to 0.10% of P, as wt %.

Reasons for limiting a double oriented electrical steel sheet will now be described.

2.0 to 6.0 wt % of Si

The silicon (Si) is an element for forming austenite during hot rolling, and it is needed to limit an added amount thereof so that it may have an austenite fraction of around 10% at about a slab heating temperature and about a hot-rolled steel sheet annealing temperature. In the secondary recrystallization annealing, formation of secondary recrystallization microstructures may be fluently generated at the time of annealing in the case of a single phase of ferrite, so it is needed to limit the component that becomes the single phase of ferrite. A single phase of ferrite is formed by adding 2.0 wt % or more with respect to pure iron, and a fraction of austenite may be controlled by an addition of C, so a lower limit of the content of Si may be 2.0 wt %. Further when it is greater than 6 wt %, cold rolling is impossible, so it is limited. In detail, 2.2 to 3.1 wt % of Si may be contained. In further detail, 2.4 to 2.9 wt % of Si may be contained so as to obtain the steel sheet with high magnetic flux density.

0.0005 to 0.04 wt % of Al

The aluminum (Al) forms an AlN and is used as an inhibitor of secondary recrystallization. In an exemplary embodiment of the present invention, cube texture may be obtained in use of the inhibitor other than a nitriding process of the conventional oriented electrical steel sheet, so the added amount of Al may be controlled in a wider range than that of the conventional oriented electrical steel sheet. Here, when added at less than 0.0005 wt %, an oxide of the steel substantially increases to deteriorate magnetism, and changes the temperature of secondary recrystallization to hinder formation of the cube orientation, so it limit is set to be 0.0005 wt %. When greater than 0.04 wt %, the temperature of secondary recrystallization substantially increases, so its industrial production becomes difficult. In detail, 0.001 to 0.003 wt % of Al may be contained.

0.0001 to 0.003 wt % of S

The sulfur (S) is combined to Cu or Mn in the steel to finely form MnS, and finely formed precipitates support the secondary recrystallization, so its added amount may be 0.0001 to 0.003 wt %. When an excessive amount is added, a surface defect and texture at the time of secondary recrystallization are not controlled by segregation of S, so it is limited by 0.003 wt %.

0.02 to 1.0 wt % of Mn

The manganese (Mn) unavoidably exists in the molten steel, but when a small amount thereof is supplied, it may be used as precipitates, and it may be added in the steel as an element changing into MnS after formation of FeS. Here, when added at more than 1.0%, a surface defect caused by Mn during an annealing at a high temperature becomes a problem, so its limit is set to be 1.0%. When added at less than 0.02 wt %, magnetism is deteriorated, so its lower limit is set to be 0.02 wt %. In detail, 0.05 to 0.5 wt % of Mn may be contained.

Mn/S Weight Ratio: 60 or More

The Mn/S represents a numerical value for preventing brittleness in the case of hot rolling, and 10 to 20 is appropriate in the oriented electrical steel sheet. In the present invention, it is needed to maintain a sufficiently high weight ratio of Mn/S so as to suppress Goss growth by S. A forming temperature, a size, and a distribution of precipitates formed by the combination of Mn and S may be controlled by controlling the weight ratio of Mn/S, and the reinforcement of the cube texture and the increase of the magnetic flux density in the rolling direction and the transverse direction may be induced at the time of secondary recrystallization by controlling the weight ratio of Mn/S. Therefore, the weight ratio of Mn/S may be controlled to be equal to or greater than 60. In detail, the weight ratio of Mn/S may be controlled to be 130 to 1000.

Equal to or Less than 0.003 wt % of N

The nitrogen (N) is an element for forming the AlN, it uses the AlN as an inhibitor, so an appropriate content may need to be acquired. When a very small amount of N is contained, a non-uniform deformation degree of texture at the time of cold rolling may be sufficiently increased to thus fail to promote growth of the cube and suppress growth of Goss at the first recrystallization. When a very large amount of N is contained, a surface defect such as a blister caused by nitrogen diffusion in a process following the hot rolling process may be generated, and excessive nitride is formed in a slab state, so rolling is not easy and production cost may increase. In detail, 0.001 to 0.003 wt % of N may be contained.

0.001 to 0.1 wt % of N may be contained in the slab. In an exemplary embodiment of the present invention, a nitriding process is included when first recrystallization annealing is performed, and part of N is removed in the secondary recrystallization annealing process, so the contents of N between the slab and the finally manufactured electrical steel sheet may be different from each other.

Equal to or Less than 0.01 wt % of C

When a large amount of carbon (C) is added after the secondary recrystallization annealing is performed, magnetic aging is generated and the iron loss substantially increases, so the upper limit is set to be 0.01 wt %. In detail, it is controlled to be 0.005 wt % or less. In detail, 0.0001 to 0.005 wt % of C may be contained.

0.02 to 0.06 wt % of C may be contained in the slab. Through this, it becomes possible to suppress concentration of stress and formation of Goss in the hot-rolled steel sheet, and generate fine precipitates. The C may increase a texture non-uniform deformation degree at the time of a cold rolling to promote growth of cube and suppress growth of Goss at the first recrystallization. When a large amount thereof is added, the concentration of stress in the hot-rolled steel sheet may be eased but the formation of Goss may not be suppressed, and it is difficult to generate fine precipitates. It substantially deteriorates the cold rolling property at the time of cold rolling, so the added amount is limited. In an exemplary embodiment of the present invention, a decarburization process is included in the first recrystallization annealing, so the contents of C of the slab and the finally manufactured electrical steel sheet may be different from each other.

Equal to or Less than 0.01 wt % of Ti

The titanium (Ti) is an element for forming composite precipitates such as a TiSiCN or forming an oxide, and it is preferable to add equal to or less than 0.01 wt % thereof. Further, the precipitates and the oxide that are stable at a high temperature hinder the secondary recrystallization, so it is needed to set the added content to be 0.01 wt % or less. It is, however, very difficult to completely remove the same in a conventional steelmaking process. In detail, equal to or less than 0.005 wt % of Ti may be contained.

0.005 to 0.10 wt % of P

The phosphorus (P) improves specific resistance of the steel, increases a cube fraction at the secondary recrystallization, and increases non-uniform deformation at the time of a cold rolling, so it is preferable to add at least 0.005 wt %. Here, when more than 0.10 wt % is added, the cold rolling property becomes very weak, so the added amount is limited. In detail, 0.01 to 0.08 wt % of P may be contained.

At least one of 0.001 to 0.1 wt % of Sb and 0.001 to 0.1 wt % of Sn may be contained.

0.001% to 0.1% of Sn and Sb

The tin (Sn) and the antimony (Sb) are elements that may be added to control first recrystallization texture. Further, when 0.001 wt % or more thereof are added, they change a formation thickness of an oxidation layer to reduce a magnetism difference between the transverse direction and the rolling direction, but when greater than 0.1 wt % thereof are added, a slip of a roll substantially increases at the time of a cold rolling, so they are limited.

At least one of equal to or less than 0.01 wt % of Mo, equal to or less than 0.01 wt % of Bi, equal to or less than 0.01 wt % of Pb, equal to or less than 0.01 wt % of Mg, equal to or less than 0.01 wt % of As, equal to or less than 0.01 wt % of Be, and equal to or less than 0.01 wt % of Sr may be further included.

The molybdenum (Mo) has an effect of suppressing intergranular embrittlement by Si on an electrical steel sheet when it is added to the boundary as an element, but it is combined with C to form precipitates such as a carbide of Mo and give a bad influence to magnetism, so it is needed to be limited to equal to or less than 0.01 wt %.

The bismuth (Bi), the lead (Pb), the magnesium (Mg), the arsenic (As), the beryllium (Be), and the strontium (Sr) are elements with which an oxide, a nitride, and a carbide are finely formed in the steel, and they support secondary recrystallization, so they may be added. However, when added at more than 0.01 wt %, a drawback that formation of secondary recrystallization becomes unstable is generated, so the added amount needs to be limited.

Further, regarding the double oriented electrical steel sheet according to the present invention, the remainder excluding the above-noted components includes Fe and unavoidable impurities. However, within the range that does not deteriorate the working effect of the present invention, inclusion of other elements is not excluded.

As described above, the double oriented electrical steel sheet according to an exemplary embodiment of the present invention precisely controls the alloying composition to form a plurality of cube texture pieces. In detail, an area fraction of crystal grains with the orientation of within 15° may be 60 to 99% from {100}<001>. In this instance, exceeding 99% signifies suppressing of island grains that are inevitably formed during secondary recrystallization and completely removing of precipitates, and for this purpose, it is limited to be 60 to 99% as an annealing time at a high temperature substantially increases.

In an exemplary embodiment of the present invention, a forsterite layer may be formed on the steel sheet, and the forsterite layer may have the fraction of the area with the thickness of 2 μm or less from the surface of the steel sheet that may be 75% or more. To apply tension in the rolling direction, the oriented electrical steel sheet forms the oxidation layer including forsterite ($Mg_2SiO_4$) with the thickness of 2 to 3 μm from the surface, and the tension is then assigned by using a difference of thermal expansion coefficients between this and a base material. However, in an exemplary embodiment of the present invention, the tension in the rolling direction signifies a compression in the transverse direction, so it is preferable to substantially reduce the same. The thin oxidation layer within 2.0 μm substantially lowers a tension assigning effect, so the tension applied to the entire sheet may be removed by spreading the thin oxidation layer at equal to or greater than 75 area % of the surface area.

An insulating layer may be formed on the forsterite layer, a thickness of an upper-side insulating layer and a thickness of a lower-side insulating layer may be respectively 0.2 to 8 μm, and a thickness difference between the upper-side insulating layer and the lower-side insulating layer may be equal to or less than 50% the thickness of the lower-side insulating layer. The forsterite layer may be formed on respective sides (an upper side and a lower side) of the steel sheet, and insulating layers may be formed on the forsterite layers formed on the upper side and the lower side. The insulating layer formed on the upper side will be referred to as an upper-side insulating layer, and the insulating layer formed on the lower side will be referred to as lower-side insulating layer. By the insulating layers on the upper side and the lower side, an appropriate insulation property may be obtained, and a punching property to be used for the generator may be obtained. Particularly, burrs may be suppressed at the time of punching by controlling the thickness difference between the upper-side insulating layer and the lower-side insulating layer.

Average roughness (Ra) of the upper-side insulating layer and average roughness (Ra) of the lower-side insulating layer are respectively 1 μm or less, and a difference between the average roughness (Ra) of the upper-side insulating layer and the average roughness (Ra) of the lower-side insulating layer may be equal to or less than 0.3 μm. In the case of a material with high roughness, burrs may not be suppressed at the time of punching, and particularly, when the roughness difference between the upper side and the lower side is very large, the burrs may not be suppressed.

The double oriented electrical steel sheet according to an exemplary embodiment of the present invention has excellent magnetism in the rolling direction and the transverse direction. In detail, Br in the rolling direction and the transverse direction are equal to or greater than 1.65 T, the Br in the circumferential direction is equal to or greater than 1.55 T, and the Br is calculated as Formula 2.

$$Br=7.87/(7.87-0.065\times[Si]-0.1105\times[Al]\times B8 \quad \text{[Formula 2]}$$

(Here, [Si] and [Al] are contents (wt %) of Si and Al, and B8 represents intensity (Tesla) of a magnetic field induced at 800 A/m.)

In the case of a large generator, a diameter of a cyclic frame is several meters, and the cyclic frame is formed by cutting the electrical steel sheet with T-shaped teeth. Here, the T-shaped teeth portion is set in the transverse direction, and the rolling direction may be provided in a cyclic frame, or on the contrary, the T-shaped teeth portion may be set in the rolling direction, and the transverse direction may be provided in a cyclic frame. The change of design is determined by a length of the teeth, a diameter length of the cyclic frame, and a width of the cyclic frame. The conventional teeth portion represents a portion where a magnetic flux flows when the generator is driven, and the magnetic flux is discharged to the cyclic portion. In consideration of energy generated at this moment, it is determined whether the rolling direction and the transverse direction are set to be the teeth portion or the cyclic portion, and when the Br is a material with a very high magnetic flux density of 1.65 T or more, it has very high energy efficiency in any case without a need to distinguish to which portion the rolling direction and the transverse direction are used. Further, when the magnetic flux density of the Br in the circumferential direction becomes high enough to be equal to or greater than 1.55 T, the energy loss caused by the magnetic flux on the T-shaped teeth portion and a connection portion of the cyclic frame is greatly reduced. By this, efficiency of the generator may be improved, or a generator with high efficiency may be produced with a small core by reducing the width of the cyclic frame and the size of the teeth portion.

When it is processed with a core divided into an electrical device with a high designed magnetic flux, for example, a generator or a motor, or a smaller core that is not divided but is used by using the electrical steel sheet with an excellent characteristic in which Bh in the rolling direction is equal to or greater than 1.8 T and the same in the transverse direction is equal to or greater than 1.7 T, an amount of an excitation current is reduced, and efficiency of the electrical device may be substantially improved.

When the magnetic field of 1.5 T is applied, permeability $U_{DC}$ at the measured frequency of 0.01 Hz or less may be 1.2 times the permeability $U_{50}$ at 50 Hz.

A wind power generator without a gear from among the generators has a very slow rotating field, so the value of a current flowing to a circuit is substantially influenced by the permeability of equal to or less than 0.01 Hz than the conventional permeability of 50 Hz, so when the permeability of 0.01 Hz or less is 1.2 times or more the permeability of 50 Hz, generation of heat by the current is substantially reduced, and efficiency of the generator may be improved.

The value of Br measured after annealing the electrical steel sheet for 1 to 2 hours at the temperature of 750° C. to 880° C. may be 1.65 T or more.

$$Br=7.87/(7.87-0.065\times[Si]-0.1105\times[Al])\times B8 \quad \text{[Formula 2]}$$

(Here, [Si] and [Al] are contents (wt %) of Si and Al respectively.)

(B8 represents intensity (Tesla) of the magnetic field induced at 800 A/m.)

The Bh in the rolling direction is equal to or greater than 1.8 T, the Bh in the transverse direction is equal to or greater than 1.7 T, the Bh in the circumferential direction is equal to or greater than 1.6 T, and the Bh is calculated as expressed in Formula 3.

$$Bh=7.87/(7.87-0.0.065\times[Si]-0.1105\times[Al])\times B25 \quad \text{[Formula 3]}$$

(Here, [Si] and [Al] are contents (wt %) of Si and Al respectively.)

(B8 represents intensity (Tesla) of the magnetic field induced at 2500 A/m.)

A method for manufacturing a double oriented electrical steel sheet according to an exemplary embodiment of the present invention includes: manufacturing a slab including 2.0 to 6.0% of Si, 0.0005 to 0.04% of Al, 0.0001 to 0.003% of S, 0.02 to 1.0% of Mn, 0.001 to 0.01% of N, 0.02 to 0.06% of C, equal to or less than 0.01% of Ti (excluding 0%), and 0.005 to 0.10% of P, as wt %, and a remainder including Fe and inevitable impurities, and satisfying Formula 1; heating the slab; manufacturing a hot-rolled steel sheet by hot rolling the slab; manufacturing a cold-rolled steel sheet by cold rolling the hot-rolled steel sheet; performing first recrystallization annealing to the cold-rolled steel sheet; and performing secondary recrystallization annealing to the cold-rolled steel sheet having undergone the first recrystallization annealing.

$$[Mn]/[S]\geq 60 \quad \text{[Formula 1]}$$

(Here, [Mn] and [S] are contents (wt %) of Mn and S, respectively.)

The respective steps will now be described in detail.

First, the slab is manufactured. A reason for limiting an adding ratio of respective compositions in the slab corresponds to the reason for limiting the compositions of the double oriented electrical steel sheet, so no repeated descriptions will be provided. In a manufacturing process of hot rolling, hot-rolled steel sheet annealing, cold rolling, first recrystallization annealing, and secondary recrystallization annealing to be described, the composition of the slab other than C and N is not substantially changed, so the composition of the slab substantially corresponds to the composition of the double oriented electrical steel sheet.

The slab may satisfy Formula 4.

$$[C]/[Si]\geq 0.0067 \quad \text{[Formula 4]}$$

(Here, [C] and [Si] are contents (wt %) of C and Si in the slab, respectively.)

When a very small amount of C is contained or a very large amount of Si is contained, it may become difficult to promote growth of cubes and suppress growth of Goss. In detail, a left side of Formula 4 may be 0.0083 or more.

The slab may be manufactured by using a thin slab method or a strip casting method. The slab may be 200 to 300 mm thick.

The slab is then heated.

In the heating of the slab, the time at equal to or greater than 1100° C. may be 25 to 50 minutes.

When the time at equal to or greater than 1100° C. is not appropriately obtained, a crystal grain size of the hot-rolled steel sheet may not be appropriately obtained, or a large amount of coarsened precipitates of 0.5 μm or more are produced, so the magnetism in the transverse direction may not be appropriately obtained.

The hot-rolled steel sheet is manufactured by hot rolling the slab.

In the manufacturing of a hot-rolled steel sheet, at least two passes may be included, reduction ratios of a final pass and a pass prior to the final pass may be 15 to 40%, respectively, and the sum of the reduction ratios of the final pass and the pass prior to the final pass may be equal to or less than 55%.

The last pass of the hot rolling has the lowest hot rolling temperature, and its rolling property is very poor. It is not preferable to perform rolling with a plurality of reduction ratios in the above-noted temperature range. Further, the fraction of crystal grains in the Goss orientation tend to substantially increase on the surface of the hot-rolled steel sheet as the reduction ratio increases in the two last passes, so in order to suppress this, it is needed to set the reduction ratios of respective passes to be 10 to 40% and set the sum of the reduction ratios of the two passes to be 55% or less.

The hot rolling finishing temperature may be equal to or less than 950° C. The crystal grains with the elongated cube orientation in the hot-rolled steel sheet store much more energy by the lowness of the hot rolling finishing temperature, and hence, the cube fraction may be increased at the time of annealing the hot-rolled steel sheet.

The hot-rolled steel sheet may be 1 to 2 mm thick.

After the manufacturing a hot-rolled steel sheet, a step of annealing the hot-rolled steel sheet may be further included.

In the step of annealing the hot-rolled steel sheet, the time at equal to or greater than 1100° C. may be 5 to 50 seconds. To produce fine precipitates after annealing the hot-rolled steel sheet, the precipitates formed on the slab are not coarsened, and it is preferable to limit the time so as to generate finer ones.

Further, when the thickness of the slab is set to be Tslab, and the thickness of the hot-rolled steel sheet is set to be Thot-coil, the annealing time at equal to or greater than 1100° C. from among the annealing time of the slab in the heating of the slab may be performed to be shorter than the time for annealing a hot-rolled steel sheet at equal to or greater than 1100° C. in the annealing of a hot-rolled steel sheet by equal to or greater than 2×Tslab/Thot-coil times and equal to or less than 4×Tslab/Thot-coil times. This aims at making finer precipitates on the slab, and the slab is thicker than the hot-rolled steel sheet, so it is difficult to obtain fine precipitates in the thickness direction in a more uniform way. Therefore, coarsening of the precipitates on the slab may be suppressed by limiting the time.

After the annealing of a hot-rolled steel sheet, an average crystal grain diameter of the hot-rolled steel sheet may be 100 to 200 μm. When the crystal grain size is coarsened, the possibility for crystal grain nuclei of the Goss orientation to be formed is increased by a shear band formed at the time of rolling, so it is needed to limit the size to be 200 μm or less. The crystal grain size may be measured by assuming a sphere with a same volume and measuring a diameter of the sphere by a standard method for measuring a crystal grain size.

After the annealing of a hot-rolled steel sheet, the number of precipitates with the particle diameter of 0.1 μm or more is 100 to 4000 in the area of 1 $mm^2$ of the hot-rolled steel sheet, and a ratio (A/B) of the number (A) of the precipitates with the particle diameter of 0.1 to 0.5 μm against the number (B) of the precipitates with the particle diameter of greater than 0.5 μm may be equal to or greater than 1.

This is because the cube texture may be obtained when an appropriate number of precipitates are acquired. Further, when an appropriate ratio of the coarsened precipitates and the fine precipitates is formed, the secondary recrystallization is fluently performed, and the magnetisms in the rolling direction and the transverse direction may become excellent.

An annealing temperature in the annealing of a hot-rolled steel sheet may be 1000 to 1200° C.

The temperature T2 of the annealing of a hot-rolled steel sheet and the temperature T1 of the heating of the slab may satisfy Formula 5.

$$-200 \leq T1 - T2 \leq 30 \quad \text{[Formula 5]}$$

When failing to satisfy Formula 5, a large amount of coarsened precipitates are generated on the hot-rolled steel sheet, and the magnetism in the transverse direction may be deteriorated.

After the heating of the slab, the time up to the manufacturing of a hot-rolled steel sheet is 3 to 20 minutes, and the maximum temperature from the heating of the slab to the manufacturing of a hot-rolled steel sheet may be equal to or less than the annealing temperature of 20° C. in the annealing of the hot-rolled steel sheet.

After the heating of the slab, an output material becomes very fine by appropriately maintaining the time up to the manufacturing of a hot-rolled steel sheet, and allowing the maximum temperature from the heating of the slab to the manufacturing a hot-rolled steel sheet to control a relationship of the annealing temperature of the annealing of a hot-rolled steel sheet, and secondary recrystallization may be advantageous.

In the manufacturing of a cold-rolled steel sheet, the reduction ratio may be 50 to 70%. When the reduction ratio is very high, a plurality of GOSS crystals are formed. When the reduction ratio is very low, the finally manufactured steel sheet becomes thick.

In the first recrystallization annealing, a nitriding amount may be 0.01 to 0.023 wt %. When the amount of nitride is inappropriately acquired, the secondary recrystallization is not fluently formed, so the magnetism may be deteriorated.

After the first recrystallization annealing, the average crystal grain diameter of the steel sheet having undergone a first recrystallization annealing may be 32 to 50 μm. When the average crystal grain diameter of the steel sheet having undergone a first recrystallization annealing is inappropriately acquired, the secondary recrystallization is not fluently formed, so the magnetism may be deteriorated.

After the first recrystallization annealing, applying of an annealing separator including a MgO may be further included.

The forsterite layer formed by applying an annealing separator corresponds to the above description, which will therefore be omitted.

The following examples illustrate the present invention in more detail. However, an Example to be described is an exemplary embodiment of the present invention, and the present invention is not limited to the Example.

Experimental Example 1

A slab made of the components, the remainder of Fe, and the inevitable impurities expressed in Table 1 and Table 2 is manufactured, it is heated at 1150° C., it is then hot rolled and to thus manufacture a hot rolled coil that is 1.6 mm thick, it is annealed for 30 seconds at 1100° C. to 1140° C., it is annealed for 90 seconds at 900° C., and the quenched hot-rolled annealed steel sheet is cold rolled up to the reduction ratio of 63%.

The cold rolled sheet is nitrided at 0.02 wt % to pass through the first recrystallization annealing process for a decarburization in the atmosphere with a dew point of 60° C. and 75% of hydrogen so that the crystal grain size may be 36 μm. After applying an annealing separator including the component of MgO, the temperature is raised up to 1200° C. at a heating rate of 20° C. per hour, and the secondary recrystallization annealing is performed for 20 hours. The annealing separator of MgO is removed from the quenched sheet, insulating coating is performed, the magnetism is measured, and results are expressed as in Table 3. The results of measuring the magnetism, performing an annealing for two hours at 800° C., and re-measuring the magnetism are expressed in Table 3.

TABLE 1

| Specimen (wt %) | Si | Al | S | Mn | N | C | Ti | P | Mn/S | C/Si |
|---|---|---|---|---|---|---|---|---|---|---|
| A1 | 2.69 | 0.028 | 0.0009 | 0.143 | 0.0028 | 0.025 | 0.002 | 0.05 | 158 | 0.0093 |
| A2 | 2.77 | 0.028 | 0.0009 | 0.144 | 0.0027 | 0.025 | 0.002 | 0.045 | 152 | 0.009 |
| A3 | 2.53 | 0.029 | 0.0009 | 0.142 | 0.0028 | 0.023 | 0.002 | 0.049 | 156 | 0.0091 |
| A4 | 2.65 | 0.028 | 0.0009 | 0.144 | 0.0029 | 0.024 | 0.002 | 0.049 | 156 | 0.0091 |
| A5 | 2.79 | 0.028 | 0.0009 | 0.146 | 0.0028 | 0.022 | 0.002 | 0.048 | 162 | 0.0079 |
| A6 | 2.74 | 0.028 | 0.0009 | 0.146 | 0.0029 | 0.028 | 0.002 | 0.045 | 159 | 0.0102 |
| A7 | 2.71 | 0.028 | 0.0009 | 0.076 | 0.0029 | 0.023 | 0.002 | 0.047 | 84 | 0.0085 |
| A8 | 2.75 | 0.028 | 0.001 | 0.281 | 0.0029 | 0.023 | 0.002 | 0.046 | 284 | 0.0084 |
| A9 | 2.63 | 0.006 | 0.0009 | 0.149 | 0.0029 | 0.025 | 0.002 | 0.048 | 158 | 0.0095 |
| A10 | 2.36 | 0.029 | 0.0009 | 0.149 | 0.003 | 0.023 | 0.002 | 0.046 | 158 | 0.0097 |
| A11 | 3 | 0.027 | 0.0009 | 0.15 | 0.0029 | 0.025 | 0.002 | 0.046 | 162 | 0.0083 |
| A12 | 2.64 | 0.027 | 0.0009 | 0.142 | 0.003 | 0.023 | 0.002 | 0.064 | 156 | 0.0087 |
| A13 | 2.78 | 0.026 | 0.001 | 0.137 | 0.003 | 0.023 | 0.002 | 0.019 | 139 | 0.0083 |
| A14 | 2.64 | 0.029 | 0.001 | 0.145 | 0.0028 | 0.023 | 0.014 | 0.046 | 153 | 0.0087 |
| A15 | 2.77 | 0.027 | 0.0047 | 0.046 | 0.0028 | 0.024 | 0.002 | 0.046 | 10 | 0.0087 |
| A16 | 2.53 | 0.026 | 0.0009 | 0.14 | 0.0028 | 0.014 | 0.002 | 0.049 | 149 | 0.0055 |
| A17 | 2.6 | 0.028 | 0.0009 | 0.143 | 0.0029 | 0.08 | 0.002 | 0.049 | 152 | 0.0308 |
| A18 | 2.8 | 0.028 | 0.0009 | 0.135 | 0.0028 | 0.023 | 0.002 | 0.047 | 147 | 0.0082 |
| A19 | 2.72 | 0.028 | 0.001 | 0.147 | 0.0027 | 0.025 | 0.002 | 0.046 | 148 | 0.0092 |
| A20 | 2.68 | 0.028 | 0.001 | 0.148 | 0.0028 | 0.024 | 0.002 | 0.045 | 151 | 0.009 |
| A21 | 2.65 | 0.028 | 0.001 | 0.147 | 0.0029 | 0.024 | 0.002 | 0.046 | 153 | 0.0091 |
| A22 | 2.79 | 0.026 | 0.001 | 0.139 | 0.0029 | 0.024 | 0.002 | 0.046 | 140 | 0.0086 |
| A23 | 2.77 | 0.026 | 0.001 | 0.149 | 0.0029 | 0.025 | 0.002 | 0.046 | 153 | 0.009 |
| A24 | 2.77 | 0.026 | 0.0009 | 0.149 | 0.003 | 0.024 | 0.002 | 0.047 | 162 | 0.0087 |

TABLE 2

| Specimen (wt %) | Sn | Sb | Mo | Bi | Pb | Mg | As | Be | Sr |
|---|---|---|---|---|---|---|---|---|---|
| A1 | 0.005 | 0.005 | 0.003 | 0.001 | 0.0005 | 0.0005 | 0.005 | 0.00005 | 0.00005 |
| A2 | 0.03 | 0.005 | 0.003 | 0.001 | 0.0005 | 0.0005 | 0.005 | 0.00005 | 0.00005 |
| A3 | 0.005 | 0.03 | 0.003 | 0.001 | 0.0005 | 0.0005 | 0.005 | 0.00005 | 0.00005 |
| A4 | 0.03 | 0.03 | 0.003 | 0.001 | 0.0005 | 0.0005 | 0.005 | 0.00005 | 0.00005 |
| A5 | 0.005 | 0.005 | 0.003 | 0.001 | 0.0005 | 0.0005 | 0.005 | 0.00005 | 0.00005 |
| A6 | 0.005 | 0.005 | 0.003 | 0.001 | 0.0005 | 0.0005 | 0.005 | 0.00005 | 0.00005 |
| A7 | 0.005 | 0.005 | 0.003 | 0.001 | 0.0005 | 0.0005 | 0.005 | 0.00005 | 0.00005 |
| A8 | 0.005 | 0.005 | 0.003 | 0.001 | 0.0005 | 0.0005 | 0.005 | 0.00005 | 0.00005 |
| A9 | 0.005 | 0.005 | 0.003 | 0.001 | 0.0005 | 0.0005 | 0.005 | 0.00005 | 0.00005 |
| A10 | 0.005 | 0.005 | 0.003 | 0.001 | 0.0005 | 0.0005 | 0.005 | 0.00005 | 0.00005 |
| A11 | 0.005 | 0.005 | 0.003 | 0.001 | 0.0005 | 0.0005 | 0.005 | 0.00005 | 0.00005 |
| A12 | 0.005 | 0.005 | 0.003 | 0.001 | 0.0005 | 0.0005 | 0.005 | 0.00005 | 0.00005 |
| A13 | 0.005 | 0.005 | 0.003 | 0.001 | 0.0005 | 0.0005 | 0.005 | 0.00005 | 0.00005 |
| A14 | 0.005 | 0.005 | 0.003 | 0.001 | 0.0005 | 0.0005 | 0.005 | 0.00005 | 0.00005 |
| A15 | 0.005 | 0.005 | 0.003 | 0.001 | 0.0005 | 0.0005 | 0.005 | 0.00005 | 0.00005 |
| A16 | 0.005 | 0.005 | 0.003 | 0.001 | 0.0005 | 0.0005 | 0.005 | 0.00005 | 0.00005 |
| A17 | 0.005 | 0.005 | 0.003 | 0.001 | 0.0005 | 0.0005 | 0.005 | 0.00005 | 0.00005 |
| A18 | 0.005 | 0.005 | 0.025 | 0.001 | 0.0005 | 0.0005 | 0.005 | 0.00005 | 0.00005 |
| A19 | 0.005 | 0.005 | 0.003 | 0.012 | 0.0005 | 0.0005 | 0.005 | 0.00005 | 0.00005 |
| A20 | 0.005 | 0.005 | 0.003 | 0.001 | 0.011 | 0.0005 | 0.005 | 0.00005 | 0.00005 |
| A21 | 0.005 | 0.005 | 0.003 | 0.001 | 0.0005 | 0.021 | 0.005 | 0.00005 | 0.00005 |
| A22 | 0.005 | 0.005 | 0.003 | 0.001 | 0.0005 | 0.0005 | 0.022 | 0.00005 | 0.00005 |
| A23 | 0.005 | 0.005 | 0.003 | 0.001 | 0.0005 | 0.0005 | 0.005 | 0.025 | 0.00005 |
| A24 | 0.005 | 0.005 | 0.003 | 0.001 | 0.0005 | 0.0005 | 0.005 | 0.00005 | 0.013 |

TABLE 3

| Specimen | Rolling direction Br (T) | Transverse direction Br (T) | Circumferential direction Br (T) | Rolling direction Bh (T) | Transverse direction Bh (T) | Circumferential direction Bh (T) | UDC | U50 | Epstein after two-hours' annealing Br (T) | Remarks |
|---|---|---|---|---|---|---|---|---|---|---|
| A1 | 1.75 | 1.73 | 1.68 | 1.85 | 1.83 | 1.7 | 9400 | 6954 | 1.74 | Example |
| A2 | 1.708 | 1.717 | 1.669 | 1.847 | 1.825 | 1.652 | 9126 | 7229 | 1.713 | Example |
| A3 | 1.693 | 1.673 | 1.627 | 1.851 | 1.799 | 1.634 | 8828 | 6968 | 1.683 | Example |
| A4 | 1.683 | 1.709 | 1.612 | 1.848 | 1.801 | 1.629 | 8962 | 7348 | 1.696 | Example |
| A5 | 1.693 | 1.667 | 1.624 | 1.893 | 1.796 | 1.633 | 8804 | 6870 | 1.68 | Example |
| A6 | 1.735 | 1.658 | 1.672 | 1.883 | 1.765 | 1.607 | 8964 | 7304 | 1.696 | Example |
| A7 | 1.706 | 1.659 | 1.72 | 1.918 | 1.8 | 1.599 | 8826 | 7082 | 1.683 | Example |
| A8 | 1.716 | 1.699 | 1.713 | 1.898 | 1.844 | 1.601 | 9076 | 7134 | 1.708 | Example |
| A9 | 1.717 | 1.664 | 1.676 | 1.876 | 1.875 | 1.575 | 8909 | 7145 | 1.691 | Example |
| A10 | 1.742 | 1.701 | 1.674 | 1.919 | 1.838 | 1.553 | 9217 | 7218 | 1.722 | Example |
| A11 | 1.726 | 1.673 | 1.626 | 1.914 | 1.813 | 1.513 | 8997 | 7221 | 1.7 | Example |
| A12 | 1.684 | 1.634 | 1.626 | 1.905 | 1.853 | 1.486 | 8586 | 6520 | 1.659 | Example |
| A13 | 1.682 | 1.626 | 1.616 | 1.882 | 1.886 | 1.443 | 8540 | 6993 | 1.654 | Example |
| A14 | 1.73 | 1.574 | 1.541 | 1.821 | 1.717 | 1.436 | 2353 | 2674 | 0.88 | Comparative Example |
| A15 | 1.732 | 1.649 | 1.477 | 1.809 | 1.776 | 1.415 | 2531 | 2317 | 1.092 | Comparative Example |
| A16 | 1.688 | 1.595 | 1.443 | 1.783 | 1.748 | 1.357 | 2384 | 2641 | 0.903 | Comparative Example |
| A17 | 1.651 | 1.542 | 1.391 | 1.758 | 1.634 | 1.404 | 2672 | 2577 | 1.037 | Comparative Example |
| A18 | 1.585 | 1.524 | 1.405 | 1.672 | 1.708 | 1.371 | 2704 | 2557 | 1.057 | Comparative Example |
| A19 | 1.542 | 1.502 | 1.475 | 1.623 | 1.721 | 1.345 | 2328 | 2345 | 0.993 | Comparative Example |
| A20 | 1.575 | 1.539 | 1.47 | 1.633 | 1.748 | 1.402 | 2577 | 2426 | 1.062 | Comparative Example |
| A21 | 1.543 | 1.553 | 1.477 | 1.596 | 1.743 | 1.46 | 2669 | 2564 | 1.041 | Comparative Example |
| A22 | 1.511 | 1.551 | 1.426 | 1.65 | 1.662 | 1.398 | 2672 | 2306 | 1.159 | Comparative Example |
| A23 | 1.494 | 1.428 | 1.409 | 1.718 | 1.623 | 1.395 | 2681 | 2474 | 1.084 | Comparative Example |
| A24 | 1.49 | 1.445 | 1.384 | 1.659 | 1.62 | 1.451 | 2439 | 2403 | 1.015 | Comparative Example |

As expressed in Table 1 to Table 3, it is found that the example satisfying the alloying composition according to the present invention has excellent magnetism. On the contrary, it is also found that the comparative example failing to satisfy the alloying composition according to the present invention has poor magnetism.

Experimental Example 2

The annealing separator is not removed from the specimen Al of Example 1, and as expressed in Table 4, the thickness fraction is controlled, an upper-side insulating coating and a lower-side insulating coating are formed, and the magnetism is measured and is expressed in Table 5.

TABLE 4

| Specimen titles | Thickness fraction (area %) of forsterite layer at the surface of 2 μm or less | Upper-side insulating layer thickness (μm) | Lower-side insulating layer thickness (μm) | Thickness difference (μm) | Upper-side roughness (μm) | Lower-side roughness (μm) | Roughness difference (μm) |
|---|---|---|---|---|---|---|---|
| B1 | 80 | 9.5 | 3.3 | 6.2 | 0.5 | 0.4 | 0.1 |
| B2 | 80 | 3.2 | 9 | 5.8 | 0.5 | 0.4 | 0.1 |
| B3 | 80 | 2.1 | 1.8 | 0.3 | 0.5 | 0.4 | 0.1 |
| B4 | 10 | 3.5 | 2.5 | 1 | 0.5 | 0.4 | 0.1 |
| B5 | 80 | 2.1 | 1.8 | 0.3 | 1.1 | 0.9 | 0.2 |
| B6 | 80 | 3.5 | 2.5 | 1 | 0.9 | 0.4 | 0.5 |
| B7 | 50 | 2.1 | 1.8 | 0.3 | 0.5 | 0.4 | 0.1 |
| B8 | 100 | 2.1 | 1.8 | 0.3 | 0.5 | 0.4 | 0.1 |

TABLE 5

| Specimen titles | Rolling direction Br (T) | Transverse direction Br (T) | Circumferential direction Br (T) | Rolling direction Bh (T) | Transverse direction Bh (T) | Circumferential direction Bh (T) | Remarks |
|---|---|---|---|---|---|---|---|
| B1 | 1.76 | 1.61 | 1.59 | 1.85 | 1.7 | 1.65 | Comparative Example |
| B2 | 1.76 | 1.58 | 1.57 | 1.85 | 1.68 | 1.65 | Comparative Example |
| B3 | 1.76 | 1.74 | 1.65 | 1.85 | 1.83 | 1.75 | Example |
| B4 | 1.73 | 1.53 | 1.54 | 1.85 | 1.63 | 1.6 | Comparative Example |
| B5 | 1.76 | 1.45 | 1.46 | 1.85 | 1.55 | 1.55 | Comparative Example |
| B6 | 1.76 | 1.55 | 1.55 | 1.85 | 1.64 | 1.64 | Comparative Example |
| B7 | 1.74 | 1.7 | 1.63 | 1.84 | 1.81 | 1.75 | Example |
| B8 | 1.77 | 1.73 | 1.65 | 1.87 | 1.85 | 1.78 | Example |

As expressed in Table 4 and Table 5, it is found that that in the example satisfying the thickness fraction of the forsterite layer, the thicknesses of the upper-side and lower-side insulating layers, and the roughness range, has excellent magnetism. On the contrary, it is found that in the comparative example failing to satisfy the thickness fraction of the forsterite layer, the thicknesses of the upper-side and lower-side insulating layers, and the roughness range, particularly has poor magnetism in the transverse direction.

Experimental Example 3

A slab including 2.8% of Si, 0.029% of Al, 0.001% of S, 0.15% of Mn, 0.003% of N, 0.025% of C, 0.002% of Ti, 0.05% of P, as wt %, a remainder of Fe, and inevitable impurities is manufactured. The slab is heated at 1150° C., it is then hot rolled to manufacture a hot rolled coil that is 1.6 mm thick, it is annealed for 30 seconds at 1100° C. to 1140° C., and it is annealed for 90 seconds at 900° C., and the quenched hot-rolled annealed steel sheet is cold rolled up to the reduction ratio expressed in Table 6.

The cold rolled sheet is nitrided as expressed in Table 6, or undergoes an annealing process for performing a decarburization process in the atmosphere with a dew point of 60 degrees and a hydrogen atmosphere of 75%, while not being nitrided, to have the average crystal grain size expressed in Table 6. The first recrystallization specimen that is not nitrided is annealed for 30 minutes at 1150° C. by raising the temperature at a heating rate of 10° C./s in the atmosphere of the nitrogen of 100%, the annealing separator with the main component of MgO is applied to the nitrided specimen, its temperature is increased up to 1200° C. at the heating rate of 20° C. per hour, and the secondary recrystallization annealing is performed for 20 hours. The material from the two annealing processes is attached with an insulating coating, and the magnetism and the cube fraction are measured.

TABLE 6

| Specimen | Thickness of cold-rolled steel sheet (mm) | Reduction ratio of cold rolling | First recrystallization crystal grain size (μm) | Whether to nitride | Nitride amount (wt %) | Cube fraction (area %) | Rolling direction Br (T) | Transverse direction Br (T) | Circumferential direction Br (T) | Remarks |
|---|---|---|---|---|---|---|---|---|---|---|
| C1 | 0.85 | 47% | 35 | ○ | 0.02% | 55 | 1.64 | 1.62 | 1.61 | Comparative Example |
| C2 | 0.8 | 50% | 35 | ○ | 0.02% | 84 | 1.73 | 1.7 | 1.61 | Example |
| C3 | 0.7 | 56% | 36 | ○ | 0.02% | 88 | 1.72 | 1.69 | 1.62 | Example |
| C4 | 0.6 | 63% | 37 | ○ | 0.02% | 99 | 1.75 | 1.71 | 1.64 | Example |
| C5 | 0.5 | 69% | 35 | ○ | 0.02% | 80 | 1.67 | 1.66 | 1.63 | Example |
| C6 | 0.35 | 78% | 35 | ○ | 0.02% | 32 | 1.76 | 1.43 | 1.49 | Comparative Example |
| C7 | 0.64 | 60% | 37 | X | — | 45 | 1.67 | 1.65 | 1.57 | Comparative Example |
| C8 | 0.6 | 63% | 35 | X | — | 35 | 1.64 | 1.63 | 1.57 | Comparative Example |

As expressed in Table 6, it is found that the Example satisfying the cold rolling reduction ratio and the nitride amount range obtains appropriate cube texture and has excellent magnetism. On the contrary, it is found that, when the cold rolling reduction ratio is inappropriately controlled, or it is not nitrided, magnetism in the transverse direction is deteriorated or magnetism in the circumferential direction is deteriorated.

Experimental Example 4

A slab including 2.8% of Si, 0.029% of Al, 0.001% of S, 0.15% of Mn, 0.003% of N, 0.025% of C, 0.002% of Ti, 0.05% of P, as wt %, a remainder of Fe, and inevitable impurities is manufactured. The slab is heated at the temperature given in Table 7, and it is hot rolled to manufacture a hot rolling coil that is 1.6 mm thick. The hot-rolling ending temperature is summarized in Table 7.

It is annealed at the temperature shown in Table 7, and average crystal grain sizes and precipitates of the annealed hot-rolled steel sheet are expressed in Table 7. The number of the precipitates is measured with reference to the precipitates with the diameter of 0.1 μm or more, and the number of the precipitates in a random area of 1 m×1 m is measured.

The hot-rolled annealed steel sheet is cold rolled up to the reduction ratio of 63%.

The cold rolled sheet is nitrided at 0.02 wt % to undergo a first recrystallization annealing process for a decarburization in an atmosphere with a dew point of 60° C. and a hydrogen content of 75% so that the crystal grain size may be as expressed as in Table 7. An annealing separator including the component of MgO is applied, the temperature is increased up to 1200° C. at the heating rate of 20° C. per hour, and the secondary recrystallization annealing is performed for 20 hours An insulating coating is performed, magnetism is measured, and results are summarized as in Table 8.

TABLE 7

| Specimen | Slab heating temperature (T1, C) | Hot rolling ending temperature (° C.) | Slab heating time at more than 1100° C., (minutes) | Hot-rolled steel sheet annealing temperature (T2, ° C.) | Time at more than 1100° C. when annealing hot-rolled steel sheet (seconds) | Crystal grain size of hot-rolled steel sheet (μm) | Number of precipitates (number/mm$^2$) | 0.1-0.5 μm Number of precipitates (number/mm$^2$) | Number of precipitates of greater than 0.5 μm (number/mm$^2$) | First recrystallization grain size (μm) |
|---|---|---|---|---|---|---|---|---|---|---|
| D1 | 1150 | 780 | 30 | 1140 | 30 | 120 | 955 | 853 | 102 | 27 |
| D2 | 1150 | 850 | 35 | 1130 | 30 | 100 | 734 | 543 | 191 | 31 |
| D3 | 1130 | 750 | 30 | 1130 | 30 | 100 | 1033 | 943 | 90 | 31 |
| D4 | 1150 | 930 | 35 | 1100 | 30 | 80 | 654 | 312 | 342 | 34 |
| D5 | 1100 | 910 | 20 | 1130 | 30 | 100 | 432 | 135 | 297 | 35 |
| D6 | 1100 | 960 | 20 | 1100 | 30 | 80 | 54 | 21 | 33 | 32 |
| D7 | 1130 | 730 | 30 | 1130 | 60 | 350 | 7 | 3 | 4 | 34 |
| D8 | 1150 | 740 | 35 | 1150 | 3 | 150 | 6542 | 5463 | 1079 | 38 |
| D9 | 1150 | 780 | 35 | 1140 | 30 | 100 | 1020 | 754 | 266 | 37 |
| D10 | 1150 | 920 | 35 | 1140 | 30 | 100 | 354 | 193 | 161 | 36 |

TABLE 8

| Specimen | Rolling direction Br | Transverse direction Br | Circumferential direction Br | Rolling direction Bh | Transverse direction Bh | Circumferential direction Bh | Remarks |
|---|---|---|---|---|---|---|---|
| D1 | 1.72 | 1.46 | 1.45 | 1.83 | 1.55 | 1.54 | Comparative Example |
| D2 | 1.71 | 1.54 | 1.52 | 1.81 | 1.65 | 1.63 | Comparative Example |
| D3 | 1.7 | 1.43 | 1.45 | 1.8 | 1.54 | 1.53 | Comparative Example |
| D4 | 1.73 | 1.42 | 1.47 | 1.83 | 1.52 | 1.53 | Comparative Example |
| D5 | 1.72 | 1.43 | 1.48 | 1.82 | 1.55 | 1.54 | Comparative Example |
| D6 | 1.66 | 1.56 | 1.54 | 1.75 | 1.65 | 1.66 | Comparative Example |
| D7 | 1.54 | 1.48 | 1.49 | 1.66 | 1.57 | 1.55 | Comparative Example |
| D8 | 1.73 | 1.54 | 1.55 | 1.85 | 1.65 | 1.64 | Comparative Example |
| D9 | 1.73 | 1.72 | 1.65 | 1.88 | 1.86 | 1.75 | Example |
| D10 | 1.74 | 1.71 | 1.63 | 1.9 | 1.88 | 1.75 | Example |

As expressed in Table 7 to Table 8, it is found that D1 to D4, D6, and D7 having failed to obtain an appropriate first recrystallization diameter have poor magnetism in the transverse direction and poor magnetism in the circumferential direction.

Particularly, it is found that D4 has a substantially higher heating temperature than the hot-rolled steel sheet annealing temperature, so the crystal grain size of the hot-rolled steel sheet is small, a large amount of coarsened precipitates are produced, and magnetism is deteriorated. It is also found in the heating of the slab that D5 and D6 fail to obtain the time at more than 1100° C., so the precipitates are inappropriately segregated, or a large amount of coarsened precipitates are produced, and the magnetism is deteriorated. It is found that D7 and D8 have a very long or short time for annealing a hot-rolled steel sheet, so a very small or large amount of precipitates are produced and the magnetism is deteriorated.

Experimental Example 5

A slab including 2.8% of Si, 0.029% of Al, 0.001% of S, 0.15% of Mn, 0.003% of N, 0.025% of C, 0.002% of Ti, 0.05%, of P as wt %, a remainder of Fe, and inevitable impurities is manufactured. The slab is heated at 1150° C., and it is then hot rolled to manufacture a hot rolled coil that is 1.6 mm thick. After the slab is manufactured, a hot rolling ending time is summarized as Table 9. The maximum temperature from the heating of the slab to the manufacturing of a hot-rolled steel sheet is summarized in Table 9. At the time of a hot rolling, a reduction ratio of a final pass and a reduction ratio of a pass prior to the final pass are summarized in Table 9, and the sum of reduction ratios of the final pass and the pass prior thereto is given in Table 9. Annealing is performed for 30 seconds at 1100° C. to 1140° C., annealing is performed for 90 seconds at 900° C., and the quenched hot-rolled annealed steel sheet is cold rolled to the reduction ratio of 63%.

The cold rolled sheet is nitrided at 0.02 wt % to undergo a first recrystallization annealing process for decarburization in the atmosphere with the dew point of 60° C. and the hydrogen atmosphere of 75% so that the crystal grain size may be as expressed as in Table 7. An annealing separator including the component of MgO is applied, the temperature is increased up to 1200° C. at the heating rate of 20° C. per hour, and the secondary recrystallization annealing is performed for 20 hours. Insulating coating is performed, magnetism is measured, and results are summarized in Table 10.

TABLE 9

| Specimen | Hot rolling time after manufacturing slab (minutes) | Maximum temperature (° C.) | Hot-rolled steel sheet annealing temperature (° C.) | Final pass reduction ratio (%) | Pass reduction ratio prior to final pass (%) | Reduction ratio sum (%) |
|---|---|---|---|---|---|---|
| E1 | 10 | 1100 | 1130 | 15 | 30 | 45 |
| E2 | 10 | 1100 | 1130 | 20 | 30 | 50 |
| E3 | 10 | 1100 | 1130 | 50 | 50 | 100 |
| E4 | 10 | 1100 | 1130 | 30 | 40 | 70 |
| E5 | 40 | 1100 | 1130 | 15 | 30 | 45 |
| E6 | 10 | 1070 | 1130 | 10 | 20 | 30 |

TABLE 10

| Specimen | Rolling direction Br (T) | Transverse direction Br (T) | Circumferential direction Br (T) | Rolling direction Bh (T) | Transverse direction Bh (T) | Circumferential direction Bh (T) | Remarks |
|---|---|---|---|---|---|---|---|
| E1 | 1.76 | 1.74 | 1.7 | 1.86 | 1.81 | 1.76 | Example |
| E2 | 1.8 | 1.8 | 1.72 | 1.95 | 1.81 | 1.75 | Example |
| E3 | 1.65 | 1.45 | 1.47 | 1.75 | 1.55 | 1.53 | Comparative Example |
| E4 | 1.65 | 1.48 | 1.5 | 1.75 | 1.58 | 1.57 | Comparative Example |
| E5 | 1.69 | 1.43 | 1.45 | 1.78 | 1.53 | 1.54 | Comparative Example |
| E6 | 1.67 | 1.51 | 1.53 | 1.72 | 1.61 | 1.61 | Comparative Example |

As expressed in Table 9 and Table 10, it is found that the example satisfying all the conditions has excellent magnetism. On the contrary, it is found that E3 has a high reduction ratio of the final pass and the pass prior to the final pass in the hot rolling, so the magnetism is deteriorated. It is found that E4 has a high sum of reduction ratios of the final pass and the pass prior to the final pass in the hot rolling, so the magnetism is deteriorated. It is found that E5 has a long time off the hot rolling after the slab is manufactured, so the magnetism is deteriorated. It is found that E6 has a higher maximum temperature of the hot rolling after the slab is manufactured than the hot-rolled steel sheet annealing temperature, and the reduction ratio of the final pass is low, so the magnetism is deteriorated.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims. Therefore, the embodiments described above are only examples and should not be construed as being limitative in any respects.

What is claimed is:

1. A double oriented electrical steel sheet comprising:
2.0 to 6.0% of Si,
0.0005 to 0.04% of Al,
0.0001 to 0.003% of S,
0.02 to 1.0% of Mn,
equal to or less than 0.003% of N, excluding 0%,
equal to or less than 0.01% of C, excluding 0%,
equal to or less than 0.01% of Ti, excluding 0%,
0.005 to 0.10% of P, as wt %, and
a remainder including Fe and inevitable impurities,
wherein the double oriented electrical steel sheet satisfies Formula 1:

$$[Mn]/[S] \geq 60 \quad \text{[Formula 1]}$$

where [Mn] and [S] are contents, wt %, of Mn and S,
wherein the double oriented electrical steel sheet has Br in a rolling direction that is equal to or greater than 1.65 T, and Br is calculated from Formula 2:

$$Br=7.87/(7.87-0.065\times[Si]-0.1105\times[Al])\times B8 \quad \text{[Formula 2]}$$

where, [Si] and [Al] are contents, wt %, of Si and Al, and
B8 represents intensity, Tesla, of a magnetic field induced at 800 A/m, and
wherein an area fraction of crystal grains with an orientation within 15° from {100}<001> is 80 to 99%.

2. The double oriented electrical steel sheet of claim 1, further comprising
at least one of 0.001 to 0.1 wt % of Sb and 0.001 to 0.1 wt % of Sn.

3. The double oriented electrical steel sheet of claim 1, further comprising
at least one of equal to or less than 0.01 wt % of Mo, equal to or less than 0.01 wt % of Bi, equal to or less than 0.01 wt % of Pb, equal to or less than 0.01 wt % of Mg, equal to or less than 0.01 wt % of As, equal to or less than 0.01 wt % of Be, and equal to or less than 0.01 wt % of Sr.

4. The double oriented electrical steel sheet of claim 1, wherein a forsterite layer is formed on an the steel sheet, and a fraction of the area having a thickness greater than 0 μm and 2 μm or less of the forsterite layer is equal to or greater than 75%.

5. The double oriented electrical steel sheet of claim 4, wherein an insulating layer is formed on the forsterite layer, and a thickness of an upper-side insulating layer and a thickness of a lower-side insulating layer are respectively 0.2 to 8 μm, and a difference between the thickness of the upper-side insulating layer and the thickness of the lower-side insulating layer is equal to or less than 50% of the thickness of the lower-side insulating layer.

6. The double oriented electrical steel sheet of claim 5, wherein a difference between an average roughness (Ra) of the upper-side insulating layer and an average roughness (Ra) of the lower-side insulating layer is equal to or less than 0.3 μm.

7. The double oriented electrical steel sheet of claim 1, wherein

Br in a transverse direction are equal to or greater than 1.65 T, Br in a circumferential direction is equal to or greater than 1.55 T, and Br is calculated from Formula 2.

8. The double oriented electrical steel sheet of claim 1, wherein when a magnetic field of 1.5 T is applied, permeability UDC when a measured frequency is equal to or less than 0.01 Hz is 1.2 times or more permeability $U_{50}$ at 50 Hz.

9. The double oriented electrical steel sheet of claim 1, wherein a measured value of Br after annealing the electrical steel sheet for 1 to 2 hours at a temperature of 750° C. to 880° C. is equal to or greater than 1.65 T, and Br is calculated as Formula 2.

10. The double oriented electrical steel sheet of claim 1, wherein

Bh in a rolling direction is equal to or greater than 1.8 T, Bh in a transverse direction is equal to or greater than 1.7 T, Bh in a circumferential direction is equal to or greater than 1.6 T, and Bh is calculated from Formula 3:

$$Bh=7.87/(7.87-0.065\times[Si]-0.1105\times[Al])\times B25 \quad \text{[Formula 3]}$$

where, [Si] and [Al] are contents (wt %) of Si and Al, and B25 represents intensity, (Tesla), of a magnetic field induced at 2500 A/m.

11. A method for manufacturing a double oriented electrical steel sheet, comprising:

manufacturing a slab including 2.0 to 6.0% of Si, 0.0005 to 0.04% of Al, 0.0001 to 0.003% of S, 0.02 to 1.0% of Mn, 0.001 to 0.01% of N, 0.02 to 0.06% of C, equal to or less than 0.01% of Ti (excluding 0%), and 0.005 to 0.10% of P, as wt %, and a remainder including Fe and inevitable impurities, and satisfying Formula 1;

heating the slab;

manufacturing a hot-rolled steel sheet by hot rolling the slab;

manufacturing a cold-rolled steel sheet by cold rolling the hot-rolled steel sheet;

performing first recrystallization annealing on the cold-rolled steel sheet; and performing secondary recrystallization annealing on the cold-rolled steel sheet having undergone a first recrystallization annealing, $$[Mn]/[S]\geq 60 \quad \text{[Formula 1]}$$

where, [Mn] and [S] are contents wt % of Mn and S in the slab.

12. The method of claim 11, wherein the slab satisfies Formula 4:

$$[C]/[Si]\geq 0.0067 \quad \text{[Formula 4]}$$

where, [C] and [Si] are contents wt % of C and Si in the slab.

13. The method of claim 11, wherein in the manufacturing of a cold-rolled steel sheet, a reduction ratio is 50 to 70%.

14. The method of claim 13, wherein in the performing of a first recrystallization annealing, a nitriding amount is 0.01 to 0.023 wt %.

15. The method of claim 14, wherein after the performing of the first recrystallization annealing, an average crystal grain diameter of the steel sheet having undergone first recrystallization annealing is 32 to 50 μm.

16. The method of claim 11, further comprising, after the manufacturing of a hot-rolled steel sheet, annealing the hot-rolled steel sheet, wherein a temperature T2 in the annealing of a hot-rolled steel sheet and a temperature T1 in the heating of the slab satisfy Formula 5:

$$-200\leq T1-T2\leq 30. \quad \text{[Formula 5]}$$

17. The method of claim 16, wherein in the heating of the slab, a time at 1100° C. or more is 25 to 50 minutes.

18. The method of claim 17, wherein in the annealing of the hot-rolled steel sheet, a time at 1100° C. or more is 5 to 50 seconds.

19. The method of claim 18, wherein after the annealing of the hot-rolled steel sheet, an average crystal grain diameter of the hot-rolled steel sheet is 100 to 200 μm.

* * * * *